United States Patent [19]

Kleykamp

[11] Patent Number: 4,594,949

[45] Date of Patent: Jun. 17, 1986

[54] HOLDDOWN BAR FOR A HATCH COVER OF A RAILROAD CAR

[75] Inventor: Donald L. Kleykamp, Washington Township, Montgomery County, Ohio

[73] Assignee: Dayco Corporation, Dayton, Ohio

[21] Appl. No.: 462,730

[22] Filed: Jan. 31, 1983

[51] Int. Cl.[4] ..... B61D 39/00

[52] U.S. Cl. ..... 105/377; 293/120

[58] Field of Search ..... 16/86 A, 228, 273, 385, 16/386; 49/489, 490, 491, 492, 493; 52/45, 49, 51, 52, 55, 200, 309.16, 403, 471, 716, 717, 718; 105/377, 282 A; 248/500, 507; 285/112, 330, 425; 292/87, 241, 256.5; 403/338; 293/120, 128; 220/255, 314, 334, 344, 378

[56] References Cited

U.S. PATENT DOCUMENTS

| | | | |
|---|---|---|---|
| 1,422,139 | 7/1922 | Sandman | 105/377 |
| 2,118,746 | 5/1938 | Tinnerman | 52/717 X |
| 2,125,783 | 8/1938 | Heeman | 16/86 A X |
| 3,082,022 | 3/1963 | Moore | 285/330 X |
| 3,606,433 | 9/1971 | Kunevicius | 52/718 X |
| 3,645,573 | 2/1972 | Strang | 292/241 X |
| 3,664,270 | 5/1972 | Stark et al. | 292/256.5 X |
| 4,043,579 | 8/1977 | Meyer | 52/718 X |
| 4,126,094 | 11/1978 | Zimmerle et al. | 105/377 X |
| 4,239,008 | 12/1980 | Conlon | 105/377 |
| 4,378,742 | 4/1983 | Saylor et al. | 105/377 |

OTHER PUBLICATIONS

Admitted prior art to applicant of copending patent application, Ser. No. 412,416, filed Aug. 27, 1982—Clark et al.

*Primary Examiner*—Robert B. Reeves
*Assistant Examiner*—Dennis C. Rodgers
*Attorney, Agent, or Firm*—Joseph V. Tassone

[57] ABSTRACT

A holddown bar for a hatch cover of a railroad car, the holddown bar having opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover. The medial portion of the holddown bar has a surface adapted to engage a certain structure of the car outboard of the hatch thereof when the holddown bar is pivoted to a hatch opening position thereof. The surface of the medial portion of the holddown bar comprises a resilient bumper carrier by the holddown bar for engaging the structure of the car when the holddown bar is pivoted thereagainst whereby the bumper tends to prevent damage to that structure of the car when the holddown bar is pivoted to the open position thereof.

14 Claims, 22 Drawing Figures

HOLDDOWN BAR FOR A HATCH COVER OF A RAILROAD CAR

BACKGROUND OF THE INVENTION

1. Field of the Invention

This invention relates to an improved holddown bar for a hatch cover of a railroad car or the like.

2. Prior Art Statement

It is known to applicant to provide a holddown bar for a hatch cover of a railroad car or the like, the holddown bar having opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover, the medial portion of the holddown bar having a surface adapted to engage a certain structure of the car outboard of the hatch cover when the holddown bar is pivoted to a hatch opening position thereof.

For example, see FIGS. 1-16 of this application which disclose part of the subject matter of the copending patent application, Ser. No. 412,416, filed Aug. 27, 1982.

However, while the applicant of this application is a co-inventor of the claimed inventions set forth in the aforementioned patent application; it was the sole suggestion of applicant to provide for the integral securement of the gasket illustrated in FIG. 16 of this application, as well as FIG. 16 of the aforementioned copending patent application, namely, by having a portion of the gasket extend through an opening in the medial portion of the holddown bar so that an interlocking portion of the gasket will be disposed on the outboard surface of the holddown surface of the holddown bar.

Thus, it is applicant's belief that the structure and method of such FIGS. 16, as well as further suggestion in the copending patent application that the medial portion of the holddown bar can be provided with a longitudinal slot through which part of the gasket can be disposed, are really the sole invention of applicant and therefore do not provide an anticipation of the invention of this application as the same actually comprises part of the invention of this application as will be apparent hereinafter.

SUMMARY OF THE INVENTION

It is one feature of this invention to provide an improved holddown bar for a hatch cover of a railroad car or the like wherein the holddown bar has improved structure for preventing damage to the railroad car.

In particular, it is believed according to the teachings of this invention that when a holddown bar of a hatch cover of a railroad car is being pivoted to its open position in order to open the hatch of the railroad car, the operator usually pivots such holddown bar in such an abusive manner that the outside surface of the relatively rigid holddown bar bangs against the walkway grating of the railroad car and thereby damages such walkway grating or similar structure.

Therefore, it is believed according to the teachings of this invention that the holddown bar can be provided with a resilient bumper which will engage against the walkway grating of the railroad car in a manner to tend to prevent damage thereto even when the holddown bar is moved to its open position in the aforementioned abusive manner.

For example, one embodiment of this invention provides a holddown bar for a hatch cover of a railroad car, the holddown bar having opposed ends one of which is adapted to be pivotally mounted to the car and the other of which is adapted to be releasably latched to the car while a medial portion thereof intermediate the opposed ends is adapted to extend across the hatch cover and carries a sealing gasket in a channel thereof that is adapted to engage against the hatch cover. The medial portion of the holddown bar has a surface adapted to engage a certain structure of the car outboard of the hatch cover thereof when the holddown bar is pivoted to a hatch opening position thereof. The surface comprises a part of the gasket and thereby defines a resilient bumper carried by the holddown bar for engaging the structure of the car when the holddown bar is pivoted thereagainst whereby the bumper tends to prevent damage to the structure when the holddown bar is pivoted to the open position thereof.

Accordingly, it is an object of this invention to provide an improved holddown bar for a hatch cover of a railroad car or the like, the holddown bar of this invention having one or more of the novel features of this invention as set forth above or hereinafter shown or described.

Another object of this invention is to provide an improved railroad car having a holddown bar of this invention, the railroad car of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
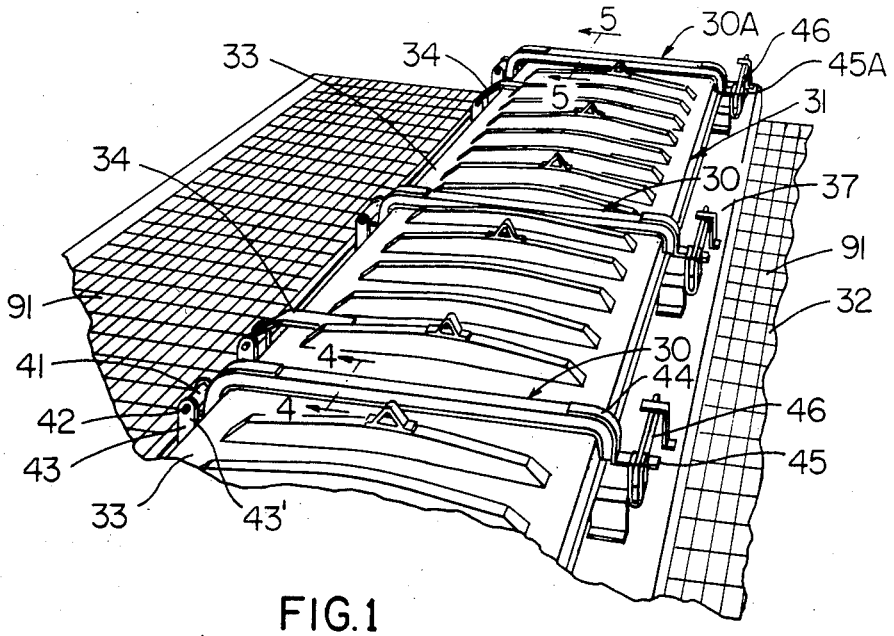
FIG.1 PRIOR ART
FIG. 1 is a fragmentary top perspective view of a railroad car having holddown bars for the hatch covers thereof, FIG. 1 illustrating prior art holddown bars.

While the various features of this invention are hereinafter illustrated and described as providing a holddown bar for a certain type of hatch cover of a railroad car, it is to be understood that the various features of this invention can be used singly or in any combination thereof to provide a holddown bar for other structures as desired.

Therefore, this invention is not to be limited to only the embodiments illustrated in the drawings, because the drawings are merely utilized to illustrate one of the wide variety of uses of this invention.

It is believed that in order to fully describe the various features of this invention, a detailed disclosure of the prior art structure should be first set forth.

Figure 2:
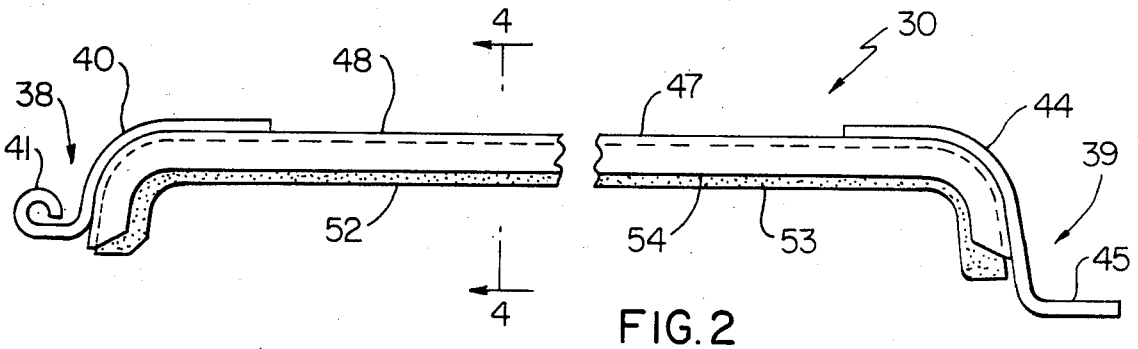
FIG.2 PRIOR ART
FIG. 2 is an enlarged side view of one of the prior art holddown bars of FIG. 1.
Figure 3:
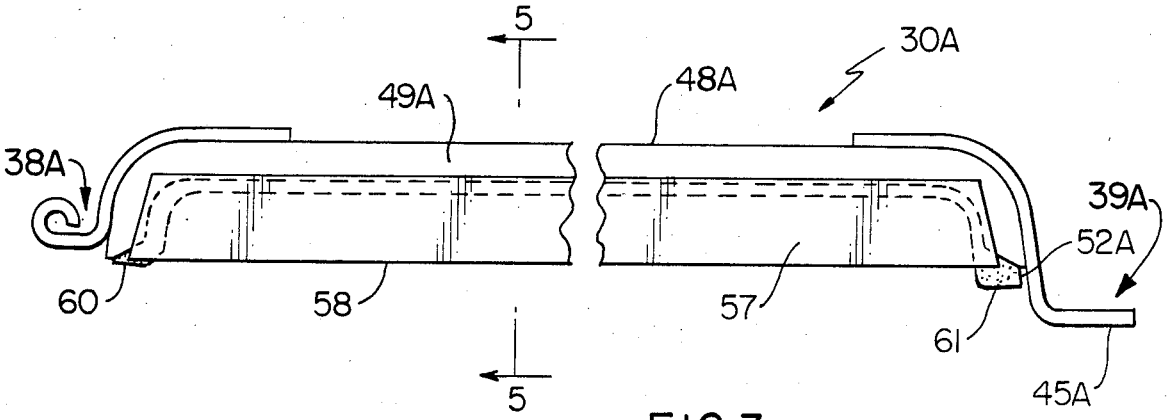
FIG.3 PRIOR ART
FIG. 3 is an enlarged side view of another of the prior art holddown bars of FIG. 1.
Figure 4:
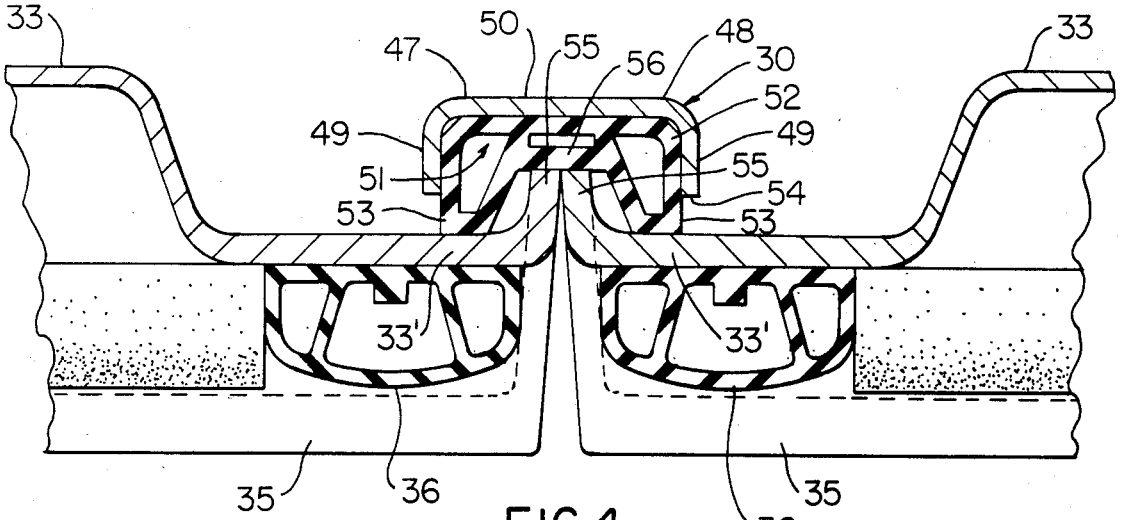
FIG.4 PRIOR ART
FIG. 4 is an enlarged fragmentary cross-sectional view taken on line 4—4 of FIG. 2 as well as on line 4—4 of FIG. 1.
Figure 5:
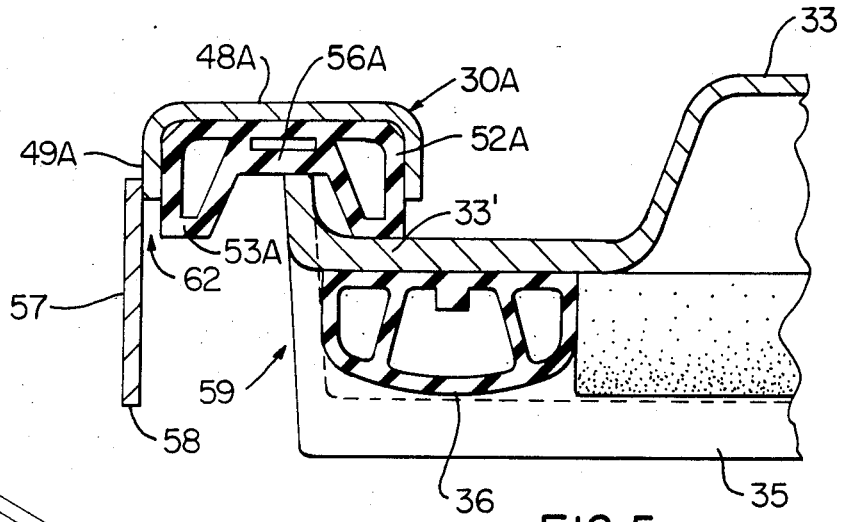
FIG.5 PRIOR ART
FIG. 5 is an enlarged fragmentary cross-sectional view taken on line 5—5 of FIG. 3 as well as on line 5—5 of FIG. 1.

Accordingly, referring now to FIGS. 1-5, one prior known holddown bar for a hatch cover of a railroad car is generally indicated by the reference numeral 30 in FIGS. 1, 2 and 4 while another prior known holddown bar is generally indicated by the reference numeral 30A in FIGS. 1, 3 and 5, the prior known holddown bars 30 and 30A being illustrated in FIG. 1 as holding closed the hatch cover unit 31 of a conventional railroad car 32.

Each hatch cover 33 of the hatch cover unit 31 has a peripheral flange 35 carrying sealing gaskets 36 which are adapted to be disposed in sealing relation against the hatch opening flange 37 and be held in sealing engagement therewith by the holddown bars 30 and 30A in a manner well known in the art to fully close the hatch opening (not shown) in the top of the railroad car 32.

The prior known holddown bar 30 has opposed ends 38 and 39 with the end 38 comprising a metal plate 40 that is formed to define a tubular part 41 that is adapted to be pivotally mounted to a pivot pin 42 of a bracket 43 carried by the railroad car 32 in a manner well known in the art whereby the holddown bars 30 are adapted to pivot on the pivot pin 42 and between the upstanding side flanges 43' of the bracket 43.

Each prior known holddown bar 30 has the other end 39 thereof formed from a metal plate 44 so shaped that the same defines a toe or latch plate 45 which is adapted to be releasably latched to the car 32 by suitable latch member 46 extending over the same as illustrated in FIG. 1 in a manner well known in the art whereby a medial portion 47 of the holddown bar 30 will extend across the respective hatch cover 33 or covers 33 to sealingly engage thereagainst and hold the respective hatch cover 33 or covers 33 in sealing relation against the hatch opening flange 37 of the railroad car 32 in a manner well known in the art.

The medial portion 47 of each holddown bar 30 comprises a metal channel member 48 having a pair of spaced parallel legs 49 and a cross member 50 that define a channel 51 which receives a resilient sealing gasket 52 therein which has side portions 53 that extend outboard of the bottom edges 54 of the legs 49 of the U-shaped channel member 48 as illustrated in FIGS. 2 and 4 so as to sealingly engage directly against the hatch cover 33 or covers 33. For example, FIG. 4 illustrates the holddown bar 30 spanning and engaging the adjacent upstanding end flanges 55 at the adjacent ends 33' of the hatch covers 33 with a central section 56 of the gasket 52 while the side portions 53 of the gasket 52 sealingly engage against the respective covers 33 inboard of the flanges 55 thereof as illustrated in FIG. 4. In this manner, not only are the adjacent ends 33' of the two hatch covers 33 held in a sealing closed condition against the hatch opening flange 37 by the holddown bar 30 of FIG. 4, but also the gasket 52 of the holddown bar 30 seals the adjacent flanges 55 to each other.

As illustrated in FIG. 1, at least one other holddown bar 30 is provided on the railroad car 32 for each hatch cover 33 and is disposed intermediate the opposed ends 33' of the respective hatch cover 33 to engage against such hatch cover 33 and hold the same in its closed condition against the hatch opening flange 37.

The metal end plates 40 and 44 that define the opposed ends 38 and 39 of each holddown bar 30 are secured to the metal channel member 48, such as by welding or the like, and the sealing gasket 52, which is formed of rubber or the like, is secured in the channel 51 of the channel member 48 by a suitable adhesive or the like. The surfaces of the metal parts of the holddown bar can be provided with protective coatings or the like.

Each holddown bar 30A is formed in substantially the same manner as the holddown bar 30 previously described whereby like parts are indicated by like reference numerals followed by the reference letter "A".

As illustrated in FIGS.3 and 5, each holddown bar 30A is formed identical to the holddown bar 30 previously described except that the same has a metal side plate 57 welded to the particular leg 49A of the channel member 48A so as to have its lower edge 58 extend closely adjacent the hatch flange 37 of the car 32 as illustrated in FIG. 5 so as to tend to protect the particular end 33' of the hatch cover 33 that is exposed to the elements at each end of the railroad car 32 in the area of the reference numeral 59 in FIG. 5 whereby the two end holddown bars 30A for each railroad car 32 have the side plates 57 on different legs 49A of their respective channel member 48A. Such side plate 57 is hereinafter referred to as a "rain shield" but it is of course to be understood that the same shields the protected hatch even from other elements of the weather than just rain.

However, it was found according to the teachings of the invention set forth in the copending patent application, Ser. No. 412,416, filed Aug. 27, 1982, that not only are the opposed ends 60 and of 61 the gasket 52A of each holddown bar 30A exposed to the elements as illustrated in FIG. 3 even though the side plate 57 is being utilized, but also the sealing gasket 52A of each holddown bar 30A as illustrated in FIG. 5 has an area in the region of the reference numeral 62 subjected to wind, ice, snow, etc. which tend to start gasket tear and, thus, early wear out of the sealing gasket 52A. In addition, it is believed that the sharp metal edges on the U-shaped channel member 48A tend to cause cutting of the gasket 52A and, thus, also early wear out thereof.

It can readily be seen from FIG. 1 that the hatch covers 33 are adapted to be latched in the closed position by the holddown bars 30 and 30A having the latch toes 45 and 45A thereof held in the latched position by the latches 46 whereby the sealing gaskets 36 of the covers 33 are held in sealing relation against the hatch opening flange 37 until it is desired to open the hatch covers 33.

In particular, in order to open a particular hatch cover 33, the latches 46 for the holddown bars 30 and 30A for that particular hatch cover 33 are opened so that the holddown bars 30 and 30A can be pivoted on their pivot ends 38 at the brackets 43 in a manner to be out of the way of the particular hatch cover 33 so that that particular hatch cover 33 can be opened on its hinge structure 34 in a manner conventional in the art.

Figure 6:
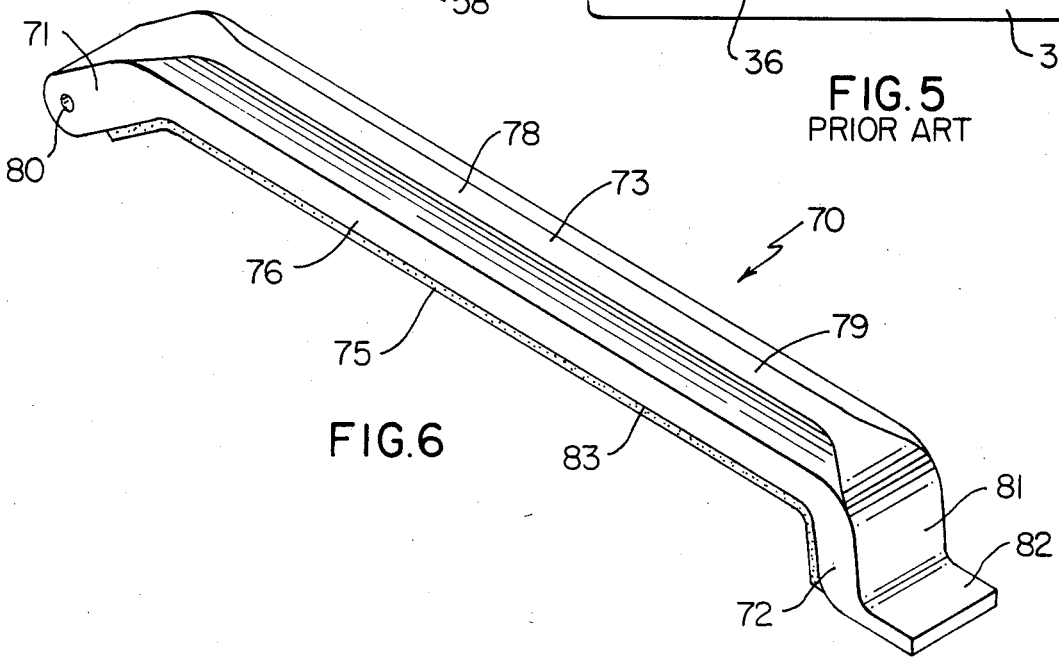
FIG. 6 is a top perspective view of one of the improved prior known holddown bars of the invention of the copending patent application, Ser. No. 412,416, filed Aug. 27, 1982.

As previously stated, it was found according to the teachings of the invention set forth in the copending patent application, Ser. No. 412,416, filed Aug. 27, 1982, that the prior known substantially all metal holddown bars 30 and 3OA can be replaced by the uniquely formed holddown bars of that invention that are generally indicated by the reference numeral 70 in FIG. 6 and 70A in FIG. 11, the holddown bars 70 of FIG. 6 to replace the intermediate holddown bars 30 of FIG. 1 and the holddown bars 70A of FIG. 11 to replace the holddown bars 30A of FIG. 1 as will be apparent hereinafter whereby this copending patent application, Ser. No. 412,416, filed Aug. 27, 1982, is being incorporated into this disclosure by this reference thereto. However, sufficient details of the holddown bars of such copending application will now be described in this application in order to fully understand the improved features of this invention.

In particular, the holddown bars 70 and 70A respectively have opposed ends 71, 72 and 71A, 72A integrally and respectively interconnected together by medial portions 73 and 73A, the medial portions 73 and 73A, as well as at least part of the respective opposed ends 71, 72 and 71A, 72A, being so constructed that the same define channels 74 and 74A therein that receive the resilient sealing gaskets 75 and 75A which are disposed between pairs of spaced apart substantially parallel legs 76 and 76A.

The holddown bars 70 and 70A are made from a relatively rigid polymeric material and are formed, such as by molding, so that the opposed ends 71, 72 and 71A, 72A, as well as the medial portions 73 and 73A thereof, respectively comprise one-piece members that form the unique configurations illustrated in the drawings.

In particular, the medial portions 73 and 73A of the holddown bars 70 and 70A are substantially straight with the top portions 78 and 78A thereof each having a substantially trapezoidal cross-sectional configuration so as to provide substantially streamlined top surfaces 79 and 79A of the respective holddown bars 70 and 70A, as well as added strength to the medial portions 73 and 73A thereof.

Figure 8:
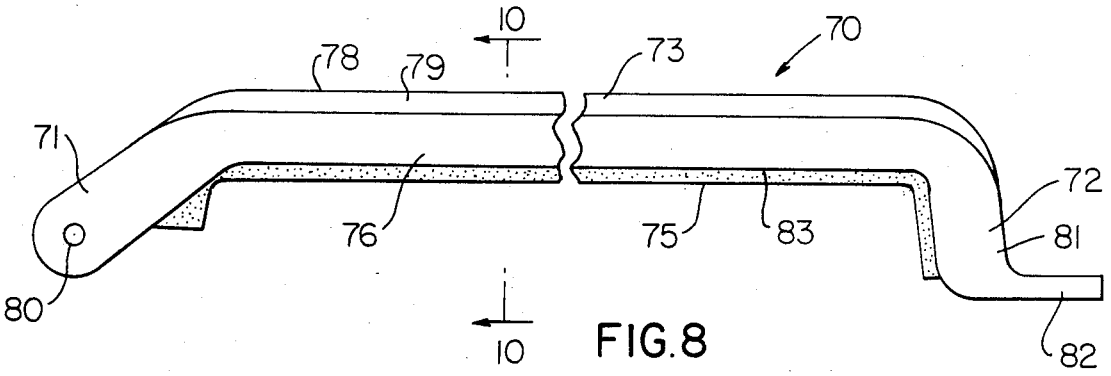
FIG. 8 is a side view of the holddown bar of FIG. 7.
Figure 9:
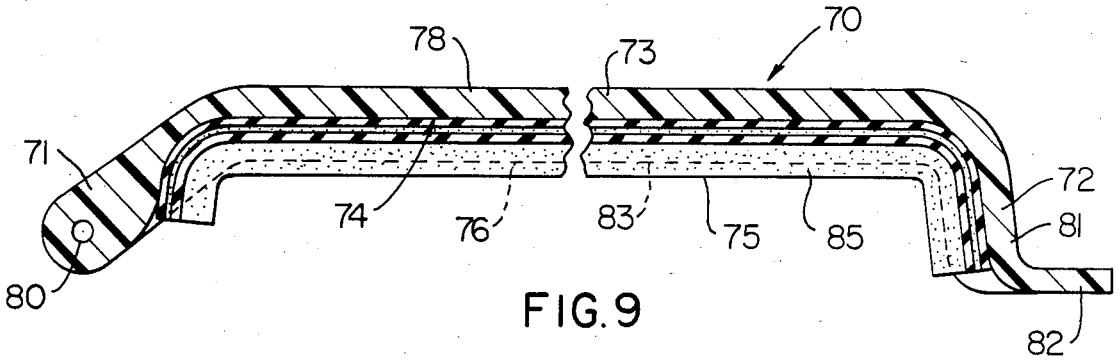
FIG. 9 is a cross-sectional view taken on line 9—9 of FIG. 7.
Figure 11:
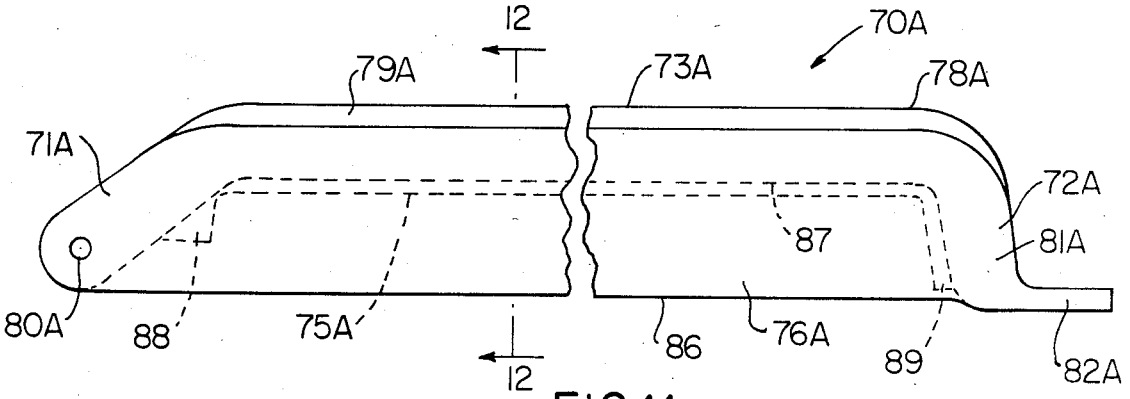
FIG. 11 is a side view of another improved prior known holddown bar of the invention of the aforementioned copending patent application.

The ends 71 and 71A of the respective holddown bars 70 and 70A are substantially straight and are respectively disposed at obtuse angles relative to the respective medial portions 73 and 73A as illustrated respectively in FIGS. 8 and 11.

In this manner, the ends 71 and 71A of the holddown bars 70 and 70A respectively have the same width as the pair of legs 76 and 76A as well as provide relatively large masses of material to have the respective pivot holes 80 and 80A passing therethrough for respectively receiving the pivot pins 42 of the brackets 43 of the railroad car 32 when the same are utilized to replace the holddown bars 30 and 30A as previously described.

Figure 7:
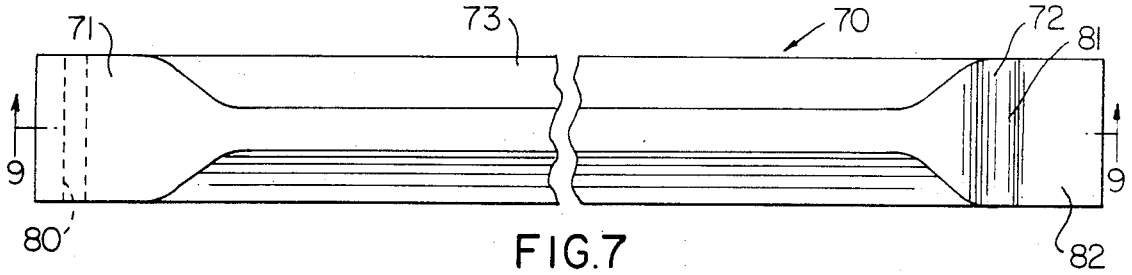
FIG. 7 is a top view of the holddown bar of FIG. 6.

The other ends 72 and 72A of the respective holddown bars 70 and 70A are substantially L-shaped and are defined by a pair of legs 81, 82 and 81A, 82A that join each other substantially at a right angle while the legs 81 and 81A respectively join the medial portions 73 and 73A substantially at right angles as illustrated respectively in FIGS. 8 and 11. The ends 72 and 72A are substantially the same width as the ends 71 and 71A previously described whereby the overall top view configurations of the holddown bars 70 and 70A of that invention are substantially rectangular as illustrated in FIG. 7.

Figure 10:
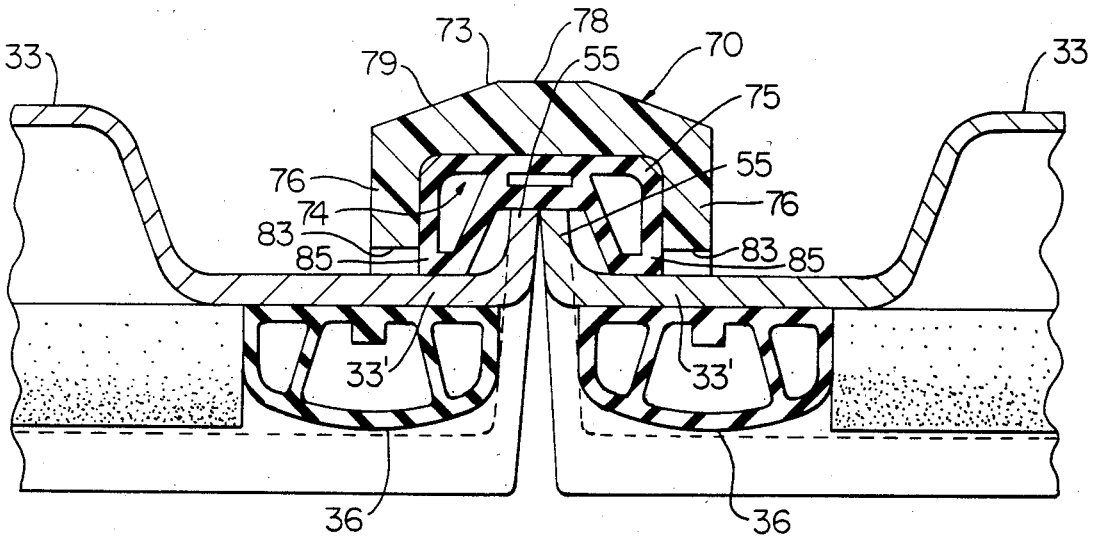
FIG. 10 is an enlarged fragmentary cross-sectional view taken on line 10—10 of FIG. 8 and illustrates the holddown bar in combination with hatch covers in a manner similar to FIG. 4.
Figure 12:
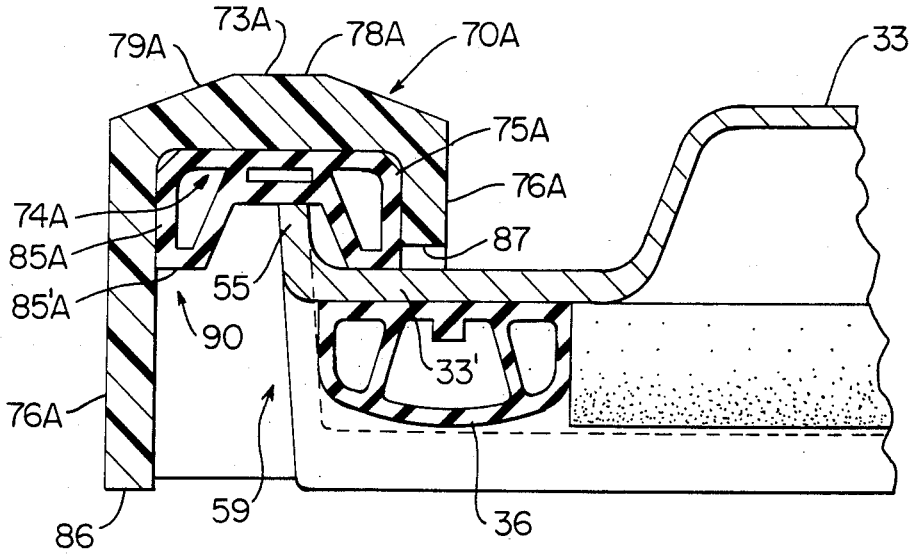
FIG. 12 is an enlarged fragmentary cross-sectional view taken on line 12—12 of FIG. 11 and illustrates the holddown bar in combination with a hatch cover in a manner similar to FIG. 5.

As illustrated in FIG. 10, the legs 76 of the holddown bar 70 respectively have bottom edges 83 which are disposed substantially coplanar with each other while the side portions 85 of the gasket means 75 extend outboard of the end edges 83 whereas in contrast the bottom edges 86 and 87 of the legs 76A of the holddown bar 70A are disposed in offset relation so that the bottom edge 86 of the longer leg 76A will extend closely adjacent the hatch opening flange 37 of the railroad car 32 as illustrated in FIG. 12 to protect the end area 59 of the adjacent end 33' of the hatch cover 33 in a believed to be more effective manner than the side plate 57 of the holddown bar 30A previously described whereby the longer leg 76A comprises a "rain shield".

In particular, it can readily be seen in FIG. 11 that the longer leg 76A has its bottom edge 86 disposed so that the same fully protects the opposed end portions 88 and 89 of the gasket 75A whereas it can readily be seen in FIG. 3 that the opposed ends 60 and 61 of the gasket 52A are exposed to the elements below the bottom edge 58 of the side plate 57 thereof.

In addition, it can readily be seen in FIG. 12 that the longer leg 76A of the holddown bar 70A is fully disposed against the sealing gasket 75A all the way to the bottom edge 85'A of the adjacent portion 85A thereof so that wind, dirt, sleet, etc. cannot enter between the longer leg 76A and the gasket 75A in the region of the reference numeral 90 whereas in contrast it can readily be seen in FIG. 5 that wind, dirt, sleet, etc. can enter into the region indicated by the reference numeral 62 to attack the lower free end 53A of the sealing gasket 52A to begin a tear area therein as previously described.

As previously stated, the holddown bars 70 and 70A can be formed from any suitable relatively rigid polymeric material that can be molded into the configurations illustrated and the gaskets 75 and 75A can be subsequently and respectively adhesively secured in the channels 74 and 74A to perform a sealing function with the flanges 55 of the hatch covers 33 as well as against points thereon inboard of the flanges 55 as illustrated respectively in FIGS. 10 and 12.

For example, the relatively rigid polymeric material for forming the holddown bars 70 and 70A can be an ultra high molecular weight synthetic plastic material, such as nylon, polyethylene, urethane, etc., having a molecular weight of between two million and six million. For example, such an ultra high molecular weight polyethylene material and a method of molding the same is disclosed in the U. S. patent to Cooper et al, U.S. Pat. No. 4,238,039 whereby this patent is being incorporated into this disclosure by this reference thereto. Also, such polymeric material for the holddown bars 70 and 70A could be reinforced, such as is disclosed in this patent to Cooper et al or in the manner set forth in the copending patent application, Ser. No. 456,154, filed Jan. 6, 1983, whereby this copending patent application is being incorporated into this disclosure by this reference thereto.

Accordingly, it can be seen that it is a relatively simple method to form the holddown bars 70 and 70A, such as by a simple molding operation, so that the same are substantially one-piece members that readily replace the holddown bars 30 and 30A of the railroad car 32 illustrated in FIG. 1 as the ends 71 and 71A thereof readily permit the same to be pivotally mounted on the pivot pins 42 of the brackets 43 and the legs 82 and 82A of the ends 72 and 72A readily accept the latches 46 to permit latching of the holddown bars 70 and 70A with their medial portions 73 and 73A extending across the hatch covers 33 in such a manner that the sealing gaskets 75 and 75A thereof will seal and hold against the hatch covers 33 so that their respective sealing gaskets 36 will readily seal against the hatch opening flange 37 in the manner previously described.

However, it has been found that the holddown bars 70 and 70A are approximately sixty percent lighter than their steel counterparts 30 and 30A whereby a weight gain advantage of approximately 35 pounds per railroad car 32 is provided when the holddown bars 70 and 70A are substituted for the holddown bars 30 and 30A and such railroad car 32 had two holddown bars 30A and three holddown bars 30.

It is also believed that the holddown bars 70 and 70A are four times more wear resistant than the stainless steel counterpart holddown bars 30 and 30A.

Since the holddown bars 70 and 70A have less weight than their steel counterparts 30 and 30A, it is believed that the holddown bars 70 and 70A will not overload their respective gaskets 75 and 75A, as well as the gaskets 36 of the hatch covers 33, so as to permit the gaskets to maintain their sealing resilience for a longer period of time.

In addition to the chemical resistance and no-rust properties of the polymeric material of the holddown bars 70 and 70A, the polymeric material thereof is compatible with the plastic material that normally forms the hatch covers 33. This is particularly important because it has been found that as railroad cars 32 vibrate, twist and torque, the weight and pressure of a steel holddown bar, with its alien physical properties, can cause undue wear and cracks in the hatch covers 33. Since hatch cover replacements are costly, it is believed that by utilizing the holddown bars 70 and 70A, since the same have substantially the same expansion, contraction and mechanical characteristics as the hatch covers 33, a major source of stress and wear on the hatch covers 33 will be eliminated.

Since the operation of the holddown bars 70 and 70A are substantially the same as the holddown bars 30 and 30A previously described, it is deemed unnecessary to further describe the operation of the holddown bars 70 and 70A except to state that same can readily replace the holddown bars 30 and 30A.

When the holddown bars 70 and 70A are formed of the aforementioned ultra high molecular weight nylon, and such material was presently the preferred material for the holddown bars 70 and 70A, such material will provide the following characteristics among others; high tensile strength for structural rigidity: maintains its strength over a wide temperature range: heat distortion only occurs at temperatures over 400° F.; has outstanding wear resistance; is approximately seven times lighter than most metals; has excellent chemical resistance; has self-extinguishing flamability characteristics; is ultraviolet resistant; is self-lubricating, such as in the hinge area that is indicated by the reference numerals 42, 43 in FIG. 1; does not rust; and provides no damage to the running boards of the railroad car 32 which are indicated by the reference numeral 91 in FIG. 1.

Therefore, it can be seen that each of the holddown bars of the aforementioned copending patent application can comprise a one-piece member formed of relatively rigid polymeric material and having or not having reinforcing therein as desired.

The holddown bars 70 and 70A previously described and illustrated in FIGS. 6–12, can have various modifications therein for various purposes. For example, the channels 74 and 74A thereof could be modified to provide other means for securing the gaskets 75 and 75A therein rather than relying solely on an adhesive securement thereto.

For example, reference is now made to FIGS. 13–16 wherein other holddown bars of the copending patent application, Ser. No. 412,416, filed Aug. 27, 1982, are respectively generally indicated by the reference numerals 70B, 70C, 70D, and 70E with parts thereof similar to the holddown bars 70 previously described being indicated by like reference numerals followed by the respective reference letter "B", "C", "D", and "E" with the understanding that either of the legs thereof could be extended to provide protection for the exposed end 33' of a hatch cover 33 in the same manner as the longer leg 76A of the holddown bar 70A previously described.

Figure 13:
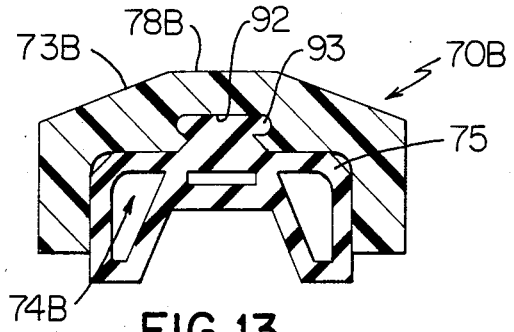
FIG. 13 is a cross-sectional view of another holddown bar of the aforementioned copending patent application.

As illustrated in FIG. 13, the holddown bar 70B is provided with a longitudinal locking groove 92 in the cross part 78B of the medial portion 73B thereof to receive a locking longitudinal protrusion 93 of the gasket 75B to mechanically secure the gasket 75B in the channel 74B of the holddown bar 70B.

Figure 14:
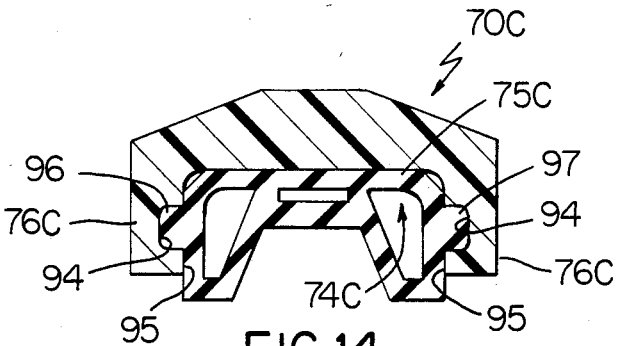
FIG. 14 is a view similar to FIG. 13 and illustrates another holddown bar of that copending patent application.

As illustrated in FIG. 14, the holddown bar 70C has longitudinal grooves 94 respectively formed in the facing sides 95 of the depending legs 76C thereof to respectively receive outwardly extending longitudinal protrusions 96 and 97 on the gasket 75C in order to mechanically secure the gasket 75C in the channel 74C of the holddown bar 70C.

Figure 15:
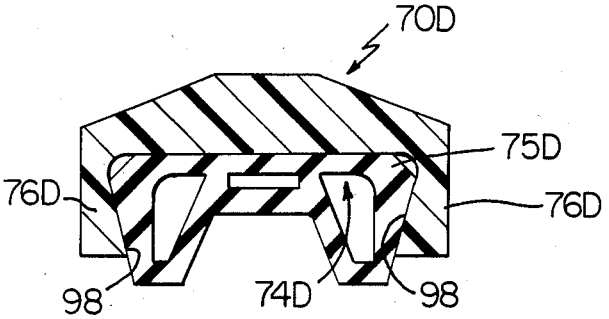
FIG. 15 is a view similar to FIG. 13 and illustrates another holddown bar of that copending patent application.

As illustrated in FIG. 15, the depending legs 76D respectively have inside facing surfaces 98 that are angled relative to each other so that the resulting channel 74D in the holddown bar 70D is dovetailed and will cause the gasket 75D to be wedged between the legs 76D as illustrated in FIG. 15 to mechanically hold the gasket 75D in the channel 74D.

Figure 16:
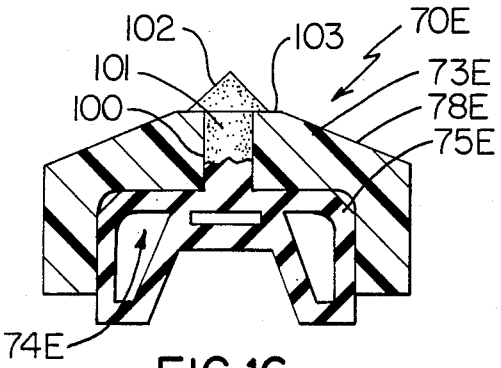
FIG. 16 is a view similar to FIG. 13 and illustrates another holddown bar of that copending patent application.
Figure 21:
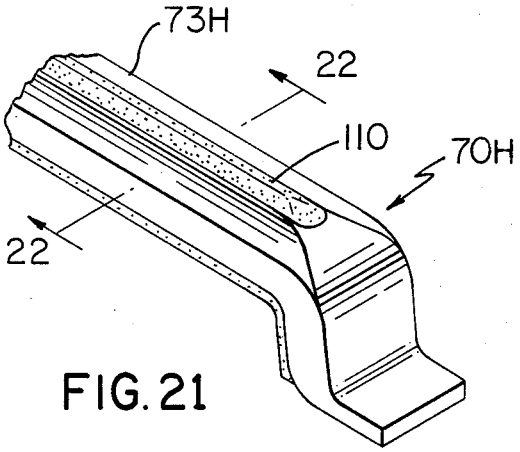
FIG. 21 is a fragmentary view similar to FIG. 17 and illustrates another embodiment of the holddown bar of this invention.
Figure 22:
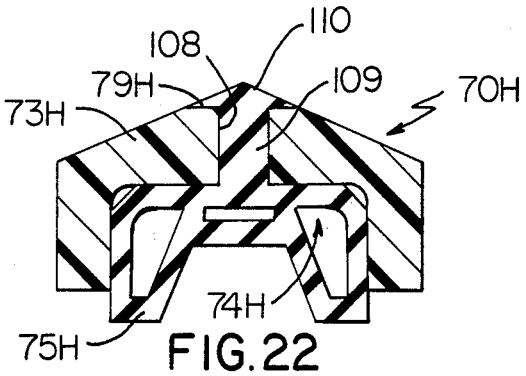
FIG. 22 is an enlarged cross-sectional view taken on line 21—21 of FIG. 20.

As illustrated in FIG. 16, the cross portion 78E of the holddown bar 70E can have a plurality of spaced apart openings 100 passing vertically therethrough and respectively receiving protrusions 101 of the gasket 75E that respectively have enlargements 102 that will snap through the openings 100 and bear against the top surface 103 of the medial portion 73E of the holddown bar 7OE in order to mechanically secure the gasket 75E in the channel means 74E thereof. Of course, the medial portion 73E of the holddown bar 70E could be provided with an elongated slot 100 throughout the longitudinal length thereof to receive a longitudinal projection 101, if desired, in the same manner as illustrated in FIGS. 21 and 22 of this application and hereinafter described.

Therefore, it can be seen that in addition to or in lieu of adhesively securing the gasket means in the channel of the holddown bar of the invention of the copending patent application, Ser. No. 412,416, filed Aug. 27, 1982, the holddown bar thereof can be modified in order to mechanically secure the gasket in the channel thereof. It is also stated in the copending patent application, Ser. No. 412,416, filed Aug. 27, 1982, that the holddown bar of that invention could be molded around the rubber gasket so as to be secured to the same or two dissimilar polymeric materials could be molded together, one for the structural member and one for the gasket.

However, as previously stated, the method and structure of securing the gasket in the channel of the holddown bar of the copending patent application, Ser. No. 412, 416, filed Aug. 27, 1982, by having a portion of the gasket pass through an opening in the medial portion of the holddown bar to be disposed on the outer side of the holddown bar so as to hold the gasket therein is the sole invention of the applicant of this application and is considered to be part of the invention of this application as will be apparent hereinafter.

Also, as previously stated, it is a feature of this invention to tend to prevent any of the previously described holddown bars, as well as other types of holddown bars, from damaging certain structures of the railroad car utilizing the same when the holddown bars are thrown back from their closed positions to their open positions by the operators desiring to open the respective hatches of the railroad car because such operators tend to pivot the holddown bars in a relatively rough manner against the walkway gratings 91 of the railroad cars 32. It is believed that such physical abuse of the walkway gratings 91 results in such walkway gratings 91 being damaged and requiring costly replacement and/or repairs thereof.

Accordingly, it is believed according to the teachings of this invention that the holddown bars can each be provided with a resilient bumper on the surface thereof that would normally engage against such walkway gratings 91 in order to cushion the impact of the holddown bar against the same whereby the walkway gratings 91 would not be subject to damage from the opening of the holddown bars having the bumper means of this invention.

Therefore, while the various features of this invention are hereinafter described and illustrated in connection with holddown bars of the type disclosed and claimed in the aforementioned patent application, Ser. No. 412,416, filed Aug. 27, 1982, it is to be understood that the various features of this invention can be utilized with the holddown bars of FIGS. 1–5 as well as with other types of holddown bars as desired.

Figure 17:
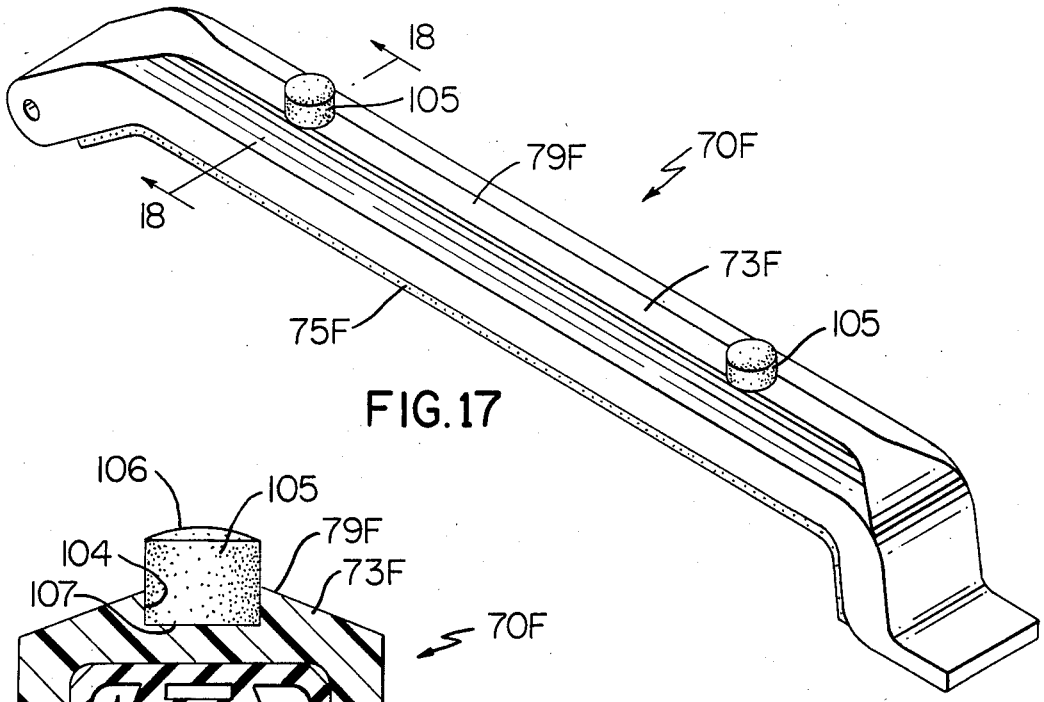
FIG. 17 is a perspective view illustrating an improved holddown bar of this invention.
Figure 18:
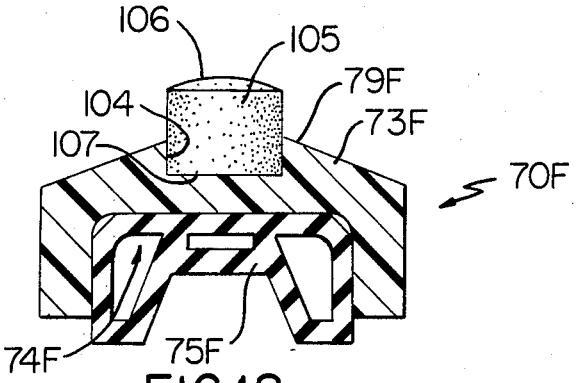
FIG. 18 is an enlarged cross-sectional view taken on line 18—18 of FIG. 17.

Accordingly, reference is now made to FIGS. 17 and 18 wherein an improved holddown bar of this invention is generally indicated by the reference numeral 70F and parts thereof similar to the holddown bars 70 previously described are indicated by like reference numerals followed by the reference letter "F".

As illustrated in FIGS. 17 and 18, the holddown bar 70F has a plurality of openings 104 formed in the medial portion 73F thereof in spaced apart relation along the top surface 79F thereof and respectively receiving resilient bumpers 105 therein, each bumper 105 having opposed ends 106 and 107 and being formed of any suitable bumper material, such as a resilient polymeric material. The end 107 of each bumper member 105 is secured in the opening 104 in any suitable manner, such as by adhesive means or the like and the other end 106 thereof is disposed in a spaced manner outwardly from the surface 79F so as to impact against walkway gratings 91 of the railroad car 32 when that particular holddown bar 70F is pivoted to its open position against the grating 91 whereby it is believed that the grating 91 will be protected from damage in contrast to the manner previously set forth for the prior known holddown bars.

While only two bumper members 105 are illustrated for the holddown bar 70F in FIGS. 17 and 18, it is to be understood that a greater number of bumper members 105 can be utilized. It is also to be understood that the configuration and/or the diameter of each bumper member 105 should be at least of a size to assure that the same will impact against a portion of the grating 91 when disposed against the same rather than be completely received in an opening through the grating 91 as is obvious.

Also, while a plurality of bumper members 105 are provided for the holddown bar 70F, it is to be understood that the bumper could comprise a single member and be of any desired configuration.

Figure 20:
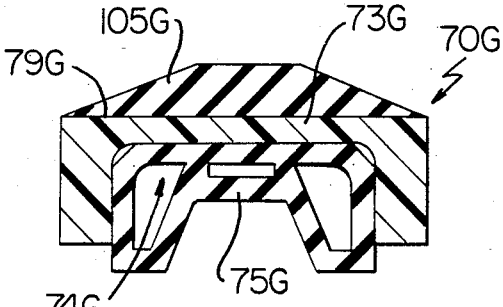
FIG. 20 is an enlarged cross-sectional view taken on line 20—20 of FIG. 19.
Figure 19:
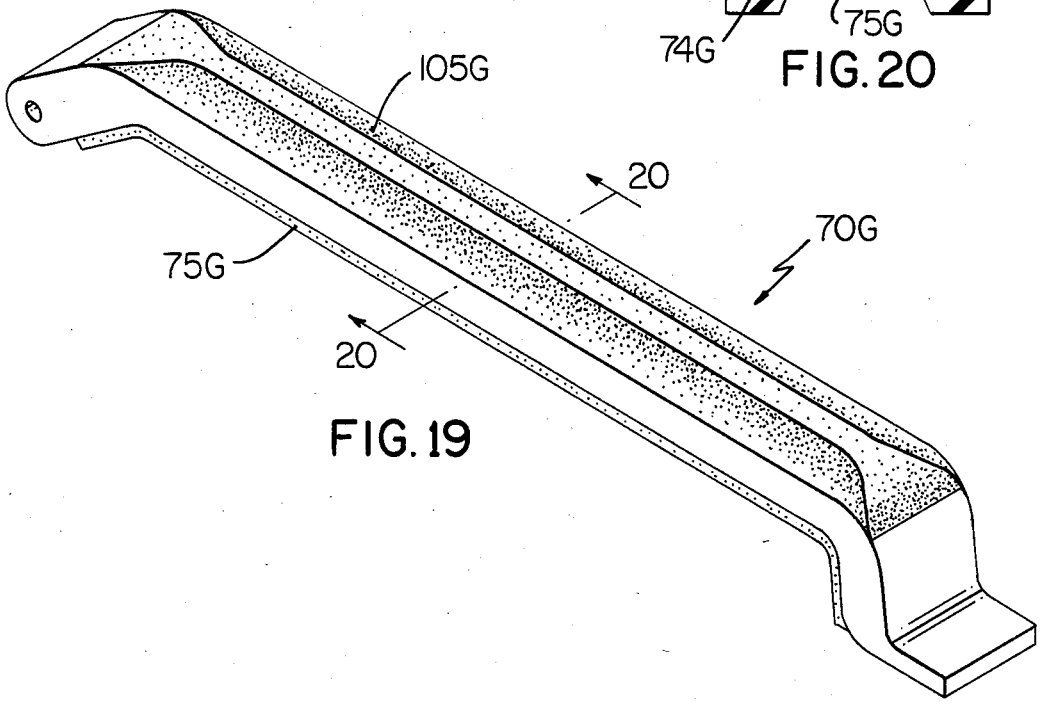
FIG. 19 is a view similar to FIG. 17 and illustrates another embodiment of the holddown bar of this invention.

For example, another holddown bar of this invention is generally indicated by the reference numeral 70G in FIGS. 19 and 20 and parts thereof similar to the holddown bar 70F previously described are indicated by like reference numerals followed by the reference letter "C".

As illustrated in FIGS. 19 and 20, the holddown bar 70G has a substantially flat top surface 79G and has a resilient bumper member lO5G secured thereto, such as by adhesive or the like, along substantially the entire length of the medial portion 73G of the holddown bar 70G as illustrated whereby only a single bumper member 105G is provided for the holddown bar 70G illustrated in FIGS. 19 and 20.

Accordingly, it can be seen that the bumper member 105G of the holddown bar 70G will impact against the grating 91 of the railroad car 32 when utilized therewith and that the entire length of the bumper member 105G will engage against the grating 91 to protect the same from the impact of the holddown bar 70G when holddown bar 70G is opened thereagainst in the manner previously described.

While the bumper members 105 and 105G of this invention have heretofore been illustrated and described as being formed of polymeric material, it is to be understood that the same can be formed of any suitable resilient material to provide the bumper function previously described.

Also, while the bumper members 105 and 105G of this invention are described as being separate parts from the respective gaskets 75F and 75G respectively secured in the channels 74F and 74G of the holddown bars 70F and 70G, it is to be understood that the bumper members of this invention could be formed of the same material as the gaskets and also be one-piece and homogeneous therewith.

In particular, reference is again made to FIG. 16 wherein the holdown bar 70E has the gasket 75E provided with a plurality of spaced apart intermediate portions 101 which respectively pass through openings 100 in the medial portion 73E of the holddown bar 70E and are interconnected to projecting portions 102 that are disposed adjacent the surface 78E of the holddown bar 70E. Accordingly, it can be seen that if each portion 102 is of a sufficient size, the same can provide a bumpers function in the same manner as the bumper means 105 and 105G previously described.

In fact, it was described in the aforementioned copending patent application Ser. No. 412,416, filed Aug. 27, 1982, and is the sole invention of the applicant of this application, that the medial portion of the holddown bar can be provided with an elongated slot therethrough and through which a projecting portion of the gasket can be disposed rather than having a plurality of individual projections 101, 102. Accordingly, it can be seen that such an arrangement could also provide the bumper function of this invention.

For example, reference is now made to FIGS. 21 and 22 wherein another holddown bar of this invention is generally indicated by the reference numeral 70H and parts thereof similar to the holddown bars 70F and 7OG previously described are indicated by like reference numerals followed by the reference letter "H".

As illustrated in FIG. 22, it can be seen that the medial portion 73H of the holddown bar 70H has a substantially longitudinal slot 108 extending along substantially the entire length thereof and in which an equally long intermediate portion 109 of the gasket 75H is disposed and is integrally interconnected to an equally long longitudinal length 110 of the gasket 75H which is disposed against the top surface 79H of the holddown bar 70H to not only mechanically secure the gasket 75H in the channel 74H in the same manner as the projections 101 and 102 of the gasket 75E previously described, but also to form a bumper for engaging against the walkway grating 91 of the railroad car 32 when the holddown bar 70H is disposed thereagainst during the opening of the hatch of the railroad car 32 utilizing such holddown bar 70H for the purpose previously described.

Therefore, it can be seen that it is a relatively simple method of this invention to form a holddown bar for a hatch cover of a railroad car or the like in such a manner that the same includes as part of the surface thereof that is adapted to be disposed against the structure of the railroad car outboard of the hatch thereof when the holddown bar is moved to its open condition a resilient bumper so as to protect that structure that is being engaged by the holddown bar in its open condition, such resilient bumper comprising one or more resilient bumper members with that bumper member either being separate from the sealing gasket of the holddown bar or being integral and one-piece therewith so as to not only perform a bumping function, but also to assist in securing the gasket in the channel of the holddown bar as previously described.

Accordingly, it can be seen that this invention not only provides an improved holddown bar for a hatch cover of a railroad car, but also this invention provides a railroad car utilizing such a holddown bar or the like.

While the forms of this invention now preferred have been illustrated and described as required by the Patent Statute, it is to be understood that other forms can be utilized and still fall within the scope of the appended claims.

What is claimed is:

1. In a railroad car having a hatch cover provided with opposed ends and a holddown bar for said hatch cover, said holddown bar having opposed ends one of which is pivotally mounted to said car and the other of which is releasably latched to said car while a medial portion thereof intermediate said opposed ends extends transvesely across said hatch cover, said medial portion of said holddown bar carrying a sealing gasket means that is adapted to engage against said hatch cover when said holddown bar is disposed in its closed position, said medial portion of said holddown bar having a surface means adapted to engage a certain structure of said car outboard of the hatch thereof when said holddown bar is pivoted to a hatch opening position thereof, the improvement wherein said surface means comprises part of said gasket means and thereby defines a resilient bumper means carried by said holddown bar for engaging said structure of said car when said holddown bar is pivoted thereagainst whereby said bumper means tends to prevent damage to said structure when said holddown bar is pivoted to said open position thereof.

2. A railroad car as set forth in claim 1 wherein said part of said gasket means comprises a plurality of resilient members disposed in spaced apart relation along said medial portion of said holddown bar.

3. A railroad car as set forth in claim 1 wherein said medial portion of said holddown bar has opening means therein, said part of said gasket means being secured in said opening means and extending outwardly from said medial portion.

4. A railroad car as set forth in claim 1 wherein said part of said gasket means comprises a single resilient member extending along substantially the entire length of said medial portion thereof.

5. A railroad car as set forth in claim 1 wherein said medial portion of said holddown bar has opening means passing therethrough, said bumper means being disposed on one side of said medial portion and another part of said gasket means being disposed on the other side of said medial portion, said bumper means and said other part of said gasket means being a one-piece homogeneous member provided with an intermediate section disposed in said opening means.

6. A railroad car as set forth in claim 5 wherein said parts of said gasket means are respectively wider than said opening means and thereby are interlocked to said medial portion by said intermediate section thereof.

7. A railroad car as set forth in claim 1 wherein said hatch cover and said holddown bar are separate parts that are adapted to be moved in sequence to their respective open and closed conditions.

8. A railroad car as set forth in claim 1 wherein said structure of said car comprises a walkway grating.

9. In a holddown bar for a hatch cover of a railroad car, said holddown bar having opposed ends one of which is adapted to be pivotally mounted to said car and the other of which is adapted to be releasably latched to said car while a medial portion thereof intermediate said opposed ends is adapted to extend across said hatch cover and carries a sealing gasket means in a channel means thereof that is adapted to engage against said hatch cover, said medial portion of said holddown bar having a surface means adapted to engage a certain structure of said car outboard of the hatch thereof when said holddown bar is pivoted to a hatch opening position thereof, the improvement wherein said surface means comprises part of said gasket means and thereby defines a resilient bumper means carried by said holddown bar for engaging said structure of said car when said holddown bar is pivoted thereagainst whereby said bumper means tends to prevent damage to said structure when said holddown bar is pivoted to said open position thereof.

10. A holddown bar as set forth in claim 9 wherein said part of said gasket means comprises a plurality of resilient members disposed in spaced apart relation along said medial portion of said holddown bar.

11. A holddown bar as set forth in claim 9 wherein said medial portion of said holddown bar has opening means therein, said part of said gasket means being secured in said opening means and extending outwardly from said medial portion.

12. A holddown bar as set forth in claim 9 wherein said part of said gasket means comprises a single resilient member extending along substantially the entire length of said medial portion thereof.

13. A holddown bar as set forth in claim 9 wherein said medial portion of said holddown bar has opening means passing therethrough, said bumper means being disposed on one side of said medial portion and another part of said gasket means being disposed on the other side of said medial portion, said bumper means and said other part of said gasket means being a one-piece homogeneous membe provided with an intermediate section disposed in said opening means.

14. A holddown bar as set forth in claim 13 wherein said parts of said gasket means are respectively wider than said opening means and thereby are interlocked to said medial portion by said intermediate section thereof.

* * * * *